US006659724B2

(12) United States Patent
Takeuchi et al.

(10) Patent No.: US 6,659,724 B2
(45) Date of Patent: Dec. 9, 2003

(54) AXIAL FAN FOR VEHICLES

(75) Inventors: Kazuhiro Takeuchi, Okazaki (JP); Shinichi Oda, Okazaki (JP); Isao Murai, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/266,151

(22) Filed: Oct. 7, 2002

(65) Prior Publication Data

US 2003/0031561 A1 Feb. 13, 2003

Related U.S. Application Data

(63) Continuation of application No. PCT/JP02/01048, filed on Feb. 7, 2002.

(30) Foreign Application Priority Data

Feb. 7, 2001 (JP) ..... 2001-031339

(51) Int. Cl.[7] ..... F04D 29/38

(52) U.S. Cl. ..... 416/185; 416/202; 416/223 R; 416/234; 416/243; 416/235; 416/236 R; 123/41.49

(58) Field of Search ..... 416/169 A, 185, 416/189, 202, 223 R, 234, 238, 243, 244 R, 235, 236 R, 236 A; 123/41.49

(56) References Cited

U.S. PATENT DOCUMENTS

| | | | | | |
|---|---|---|---|---|---|
| 1,473,066 | A | * | 11/1923 | Wells | 416/235 |
| 2,238,749 | A | * | 4/1941 | Peltier | 416/236 R |
| D131,271 | S | * | 2/1942 | Collura | 416/236 R |
| 3,727,593 | A | * | 4/1973 | Enke | 123/41.49 |
| 4,568,242 | A | * | 2/1986 | Susa et al. | 416/235 |
| 5,066,196 | A | * | 11/1991 | Morofushi | 416/234 |
| 6,065,936 | A | * | 5/2000 | Shingai et al. | 416/234 |
| 6,341,940 | B1 | * | 1/2002 | Giribaldi | 416/238 |

FOREIGN PATENT DOCUMENTS

| | | | | |
|---|---|---|---|---|
| JP | 58-66000 | | 4/1983 | |
| JP | 60-73000 | | 5/1985 | |
| JP | 60-156998 | A * | 8/1985 | 416/185 |
| JP | 3-110199 | | 11/1991 | |

OTHER PUBLICATIONS

Search Report dated Aug. 15, 2002 from corresponding PCT Application No. PCT/JP02/01048.

* cited by examiner

*Primary Examiner*—Christopher Verdier
(74) *Attorney, Agent, or Firm*—Harness, Dickey & Pierce, PLC

(57) ABSTRACT

Front edges 212*b* of blades 212 are so constituted as to be deviated toward the upstream side in the air stream beyond an axial end surface 211*a*, as viewed from a direction at right angles to the axial direction of a boss 211, and the blades 212 on the root side thereof are continuous to the axial end surface 211*a* through smoothly curved surfaces 213. This enables the air to flow from the side of the axial end surface 211*a* toward the root side of the blades 212. Due to the air flowing from the side of the axial end surface 211*a* to the root side of the blades 212, therefore, the resistance decreases between the air and the surfaces of the blades 212 on the root side, making it possible to suppress the occurrence of stalling on the root side of the blades 212. The air on the front side of the boss 211 is effectively guided toward the outer direction (toward the blades 212), preventing a drop in the flow rate and in the fan efficiency of a blower 200.

8 Claims, 7 Drawing Sheets

AXIAL FAN FOR VEHICLES

CROSS-REFERENCE TO RELATED APPLICATIONS

This application is based upon and claims priority of Japanese Patent Application No. 2001-31339, filed on Feb. 7, 2001, the contents being incorporated herein by reference, and a continuation of PCT/JP02/01048, filed Feb. 7. 2002.

TECHNICAL FIELD

The present invention relates to an axial fan, for vehicles, having a plurality of blades radially extending from a boss (hub).

BACKGROUND ART

A radiator, and a blower for blowing cold air onto the radiator, have usually been mounted on the portions where the air can be easily taken in, such as at the front end of the vehicle. Therefore, the blower is strongly affected by the air pressure caused by travelling of the vehicle.

Concretely speaking, the axial fan used for the blower is such that the air passes through in the axial direction. When the air pressure caused by travelling of the vehicle is received in the axial direction, therefore, the velocity differential becomes small between the surfaces of the blades and the air, and the resistance becomes small between the blade surfaces and the air.

In an idling condition in which the vehicle is at rest while the axial fan (blower) is in operation, on the other hand, the resistance is great between the blade surfaces and the air when there is almost no air pressure caused by travelling of the vehicle. On the root side of the blades 212 where the peripheral velocity is small, therefore, the air flow peels off the surfaces of the blades 212 and stalls. As shown in FIG. 7, therefore, the air that is blown fails to flow in the axial direction but flows in an outer radial direction.

As the air that is blown flows in the outer radial direction, the spatial size W1 through which the air substantially flows becomes smaller than the spatial size Wo in which the air substantially flows when the air that is blown is flowing in the axial direction, resulting in a decrease in the blow rate and in the fan efficiency of the blower.

This phenomenon (problem) occurs particularly conspicuously when there exists a wall surface having a large air resistance, such as an engine, on the downstream side of the axial fan.

DISCLOSURE OF THE INVENTION

In view of the above-mentioned points, therefore, it is an object of the present invention to provide an axial fan for vehicles, which suppresses a drop in the flow rate that occurs when the air that is blown does not flow in the axial direction but flows in the outer radial direction.

In order to accomplish the above-mentioned object according to one aspect of the present invention, there is provided an axial fan 210, having a plurality of blades 212 radially extending from a boss 211 to blow the air to a heat exchanger 100 mounted on the vehicle, wherein the axial end surface 211*a* of the boss 211 on the negative pressure side 212 of the blades 212 is so constituted that the air flows toward the root side of the blades 212 from the side of the axial end surface 211*a*.

Due to the air flowing toward the root side of the blades 212 from the side of the axial end surface 211*a*, therefore, the resistance decreases between the air and the blade surfaces on the root side of the blades 212, making it possible to prevent a stall on the root side of the blades 212. It is, therefore, possible to effectively make the air on the front side of the boss 211 flow toward the outer direction (toward the blades 212) and, hence, to suppress a drop in the flow rate.

According to another aspect of the present invention, there is provided an axial fan 210, having a plurality of blades 212 radially extending from a boss 211 to blow the air to a heat exchanger 100 mounted on the vehicle, wherein the front edges 212*b* of the blades 212 are deviated toward the upstream side in the air stream beyond the axial end surface 211*a* at the axial end of the boss 211 as viewed from a direction at right angles to the axial direction of the boss 211.

It is thus made possible for the air to flow from the side of the axial end surface 211*a* toward the root side of the blades 212. Due to the air flowing toward the root side of the blades 212 from the side of the axial end surface 211*a*, therefore, the resistance decreases between the air and the blade surfaces on the root side of the blades 212. It is, therefore, allowed to effectively guide the air on the front side of the boss 211 toward the outer direction (toward the blades 212) and, hence, to suppress a drop in the flow rate.

The invention can be more fully understood from the accompanying drawings and from the description of preferred embodiments of the invention.

BEST MODE FOR CARRYING OUT THE INVENTION (First Embodiment)

Figure 1A:
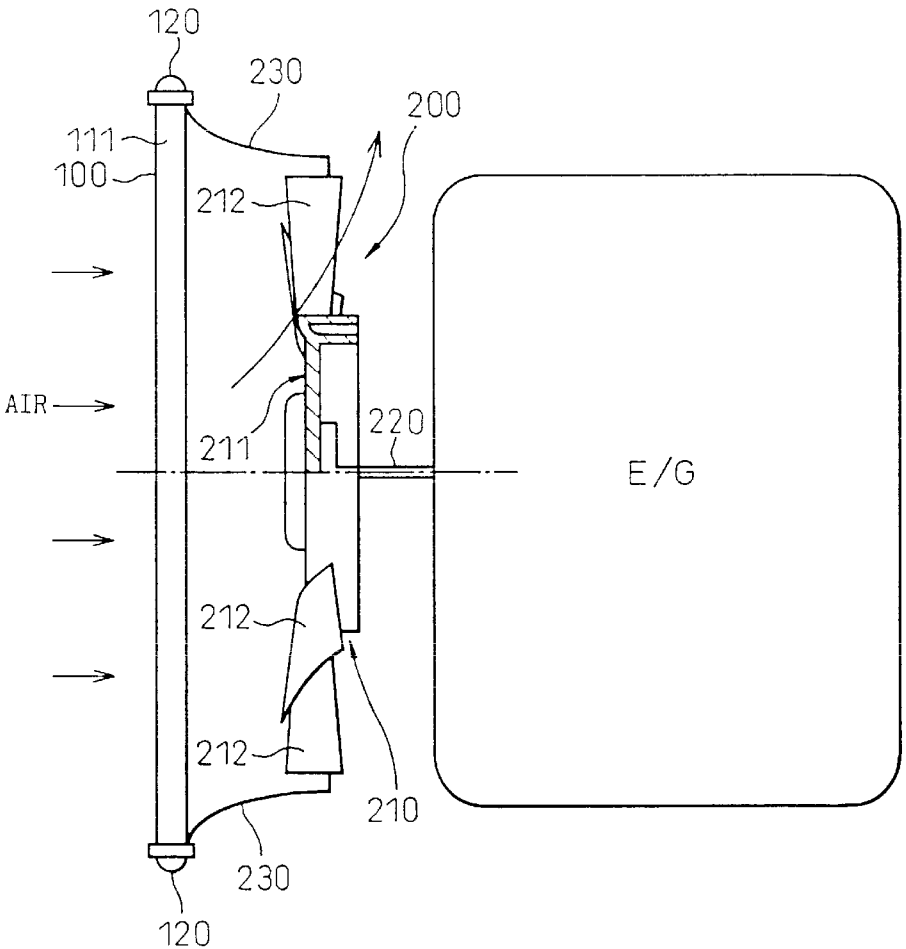
FIG. 1A is a side view of an axial fan according to a first embodiment of the present invention.

In this embodiment, the axial fan, for vehicles, of the invention is adapted to a blower that blows cooling air onto the radiator of a vehicle. FIG. 1 is a view schematically illustrating a state where a blower 200 according to the embodiment is mounted, and FIG. 2 is a schematic abstract view of FIG. 1A.

In FIG. 1A, a radiator 100 is a heat exchanger for cooling cooling water by exchanging the heat between the air and the cooling water of an engine E/G, and the blower 200 is a blower means for blowing cold air onto the radiator 100. The radiator 100 and the blower 200 are, usually, mounted on the portions where the air can be easily taken in, such as the front end of the vehicle.

Here, the radiator 100 comprises a plurality of flat tubes 111 through which the cold water flows and corrugated fins (not shown) arranged among the tubes 111 to increase the area for conducting heat to the air. Upon brazing the fins and tubes 111 together, there is constituted a radiator core for exchanging the heat between the cooling water and the air.

In this embodiment, the tubes 111 are extending up and down, and header tanks 120 are arranged at the end portions being communicated with the tubes 111. Here, the header tank 120 on the upper end side, on the surface of the paper, is for distributing the cold water to the tubes 111, and the header tank 120 on the lower end side, on the surface of the paper, is for collecting and recovering the cold water after having exchanged heat.

Figure 1B:
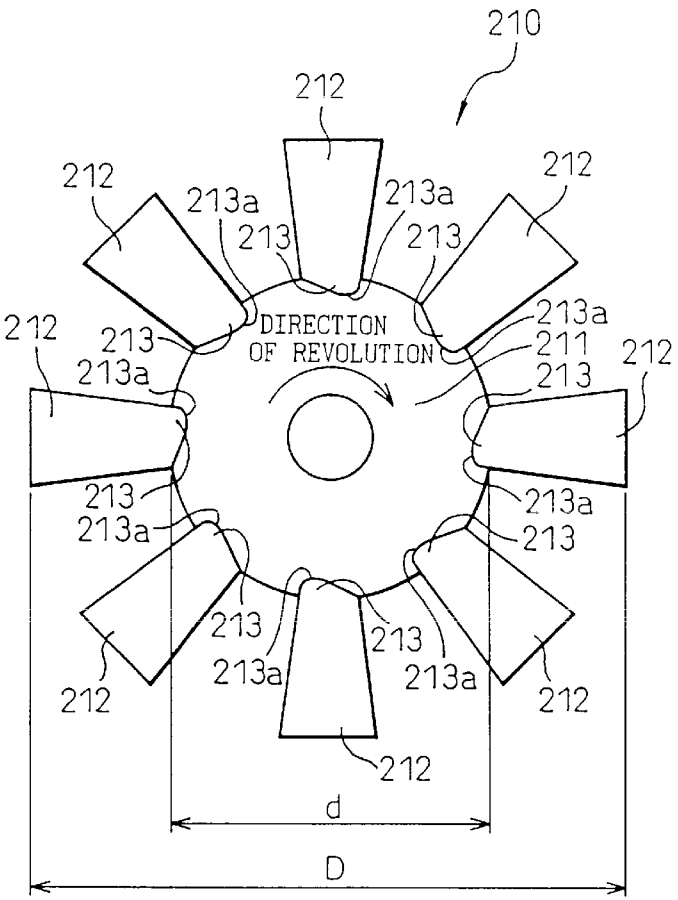
FIG. 1B is a front view of the axial fan according to the first embodiment of the present invention.
Figure 2:
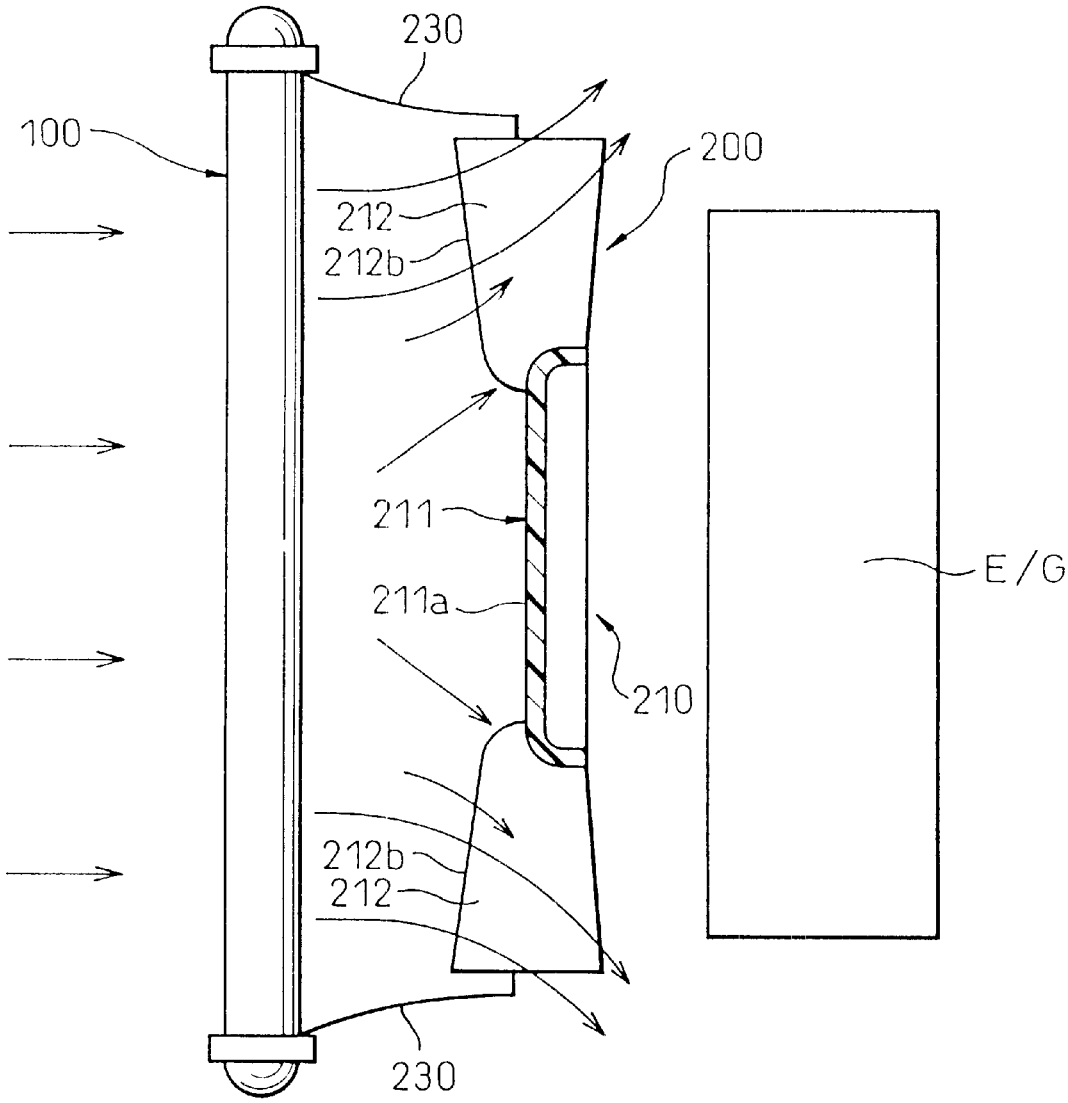
FIG. 2 is a side view schematically illustrating the axial fan according to the first embodiment of the present invention.

Referring to FIG. 1B, further, the blower 200 comprises an axial fan 210 constituted by a plurality of blades 212 radially extending from a boss 211, and a shaft 220 (see FIG. 1A) for rotating the axial fan 210. The shaft 220 obtains power from the crankshaft (not shown) of the engine E/G.

A metallic sleeve (not shown) is mounted in a portion of the boss 211 in which the shaft 220 is inserted, and the boss 211 and the blades 212 are integrally molded together by using a resin (polypropylene in this embodiment).

Therefore, the words "the boss 211 and the blades 212 are integrally molded together by using a resin" referred to in this specification do not necessarily mean that the boss 211 as a whole is made of a resin. However, the boss 211 as a whole may be made of a resin, as a matter of course.

Here, the axial fan stands for the one with which the gas (air) passes through in the axial direction as specified under JIS (Japanese Industry Standard) B 0132-1012.

In this embodiment as shown in FIG. 2, front edges 212*b* of the blades 212 which are ridges of negative-pressure surfaces 212*a* (see FIG. 3B) of the blades 212 are deviated toward the upstream side in the air stream beyond the axial end surface 211*a* at the end in the axial direction of the boss 211.

Figure 3A:
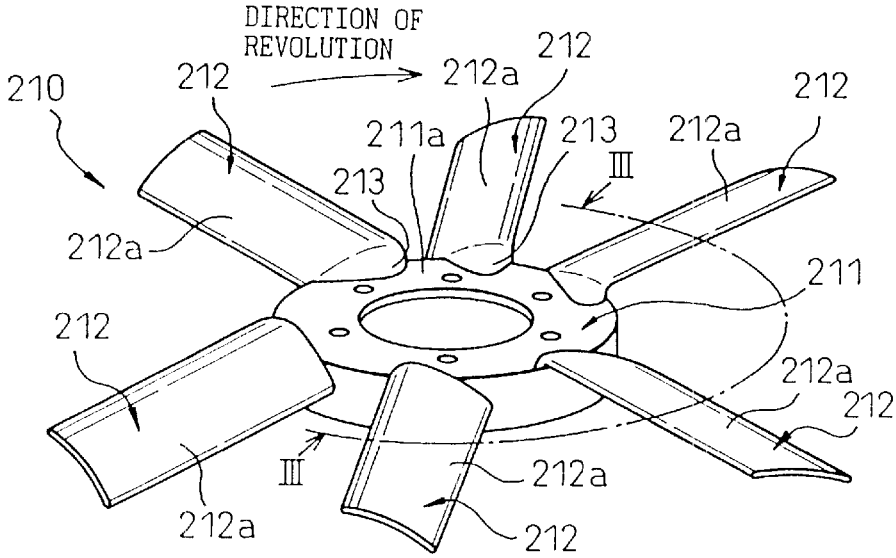
FIG. 3A is a perspective view of the axial fan according to the first embodiment of the present invention.
Figure 3B:
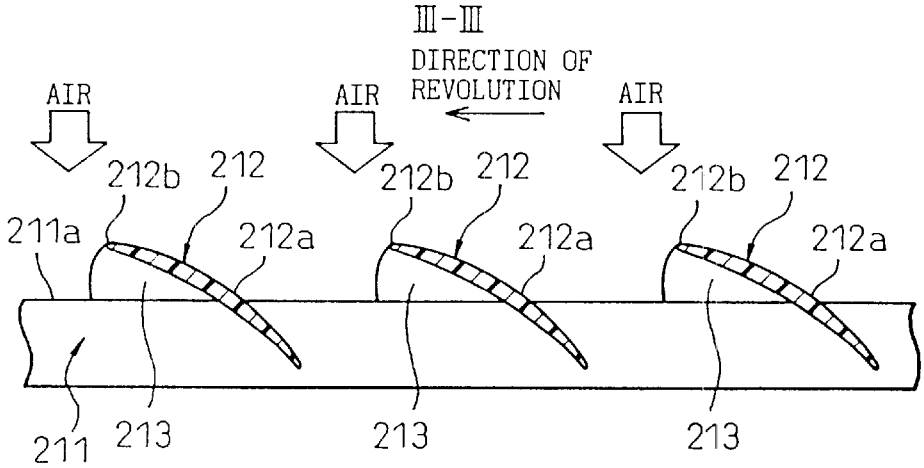
FIG. 3B is a sectional view along the line III—III in FIG. 3A.

Concretely speaking, as shown in FIGS. 3A and 3B, nearly one-half region of the blade 212 on the root side (boss 211 side) and on the front edge 212*b* side, is protruded toward the upstream side in the air stream beyond the axial end surface 211*a* positioned on the side of the negative-pressure surface 212*a*.

The negative-pressure surface of the blade stands for the surface of the blade opposite to the surface (pressure surface) facing the flow of the air as is disclosed in, for example, Fluid Engineering (Published by Tokyo University). The front edge of the blade stands for a front edge of the blade in a direction in which it travels as disclosed in the above-mentioned literature.

On the root side of the blade 212, further, a portion protruding toward the upstream in the air stream beyond the axial end surface 211*a* is connected from the root side of the blade 212 to the axial end surface 211*a* describing a smoothly curved surface 213 as shown in FIG. 3A. When viewed from the axial direction of the boss 211, the curved surface 213 is so formed that a contour line 213*a* of the curved surface 213 describes a streamline shape or a wing shape as shown in FIG. 1B.

Here, as described in the above-mentioned literature, the streamline shape stands for a shape which hardly permits the occurrence of peeling between the air stream and the body (curved surface 213 in this embodiment), and the wing shape stands for a shape which produces a lift which is considerably greater than the air resistance.

In FIGS. 1A and 2, a shroud 230 covers a gap between the axial fan 210 and the radiator 100. Therefore, the air blown out by the axial fan 210 is not sucked by the axial fan 210, i.e., the air is prevented from circulating around the axial fan 210, and the flow rate to the radiator 100 is prevented from decreasing.

Next, described below are the advantages of this embodiment.

In this embodiment, the front edges 212*b* of the blades 212 are deviated toward the upstream side in the air stream beyond the axial end surface 211*a* as viewed from the direction at right angles with the axial direction of the boss 211 and, hence, air is allowed to flow toward the root side of each blade 212 from the side of the axial end surface 211*a*.

Due to the air flowing from the side of the axial end surface 211*a* toward the root side of the blades 212 (see FIGS. 2 and 1B), therefore, the resistance decreases between the air and the blade surfaces on the root side of the blades 212 making it possible to suppress the stalling on the root side of each blade 212.

It is thus made possible to prevent air flowing in the outer radial direction, to suppress a decrease in the size of a space through which the air substantially flows, and to suppress a decrease in the flow rate and in the fan efficiency of the blower 200.

Further, the root side of each blade 212 is continuous to the axial end surface 211*a* through the smoothly curved surface 213, enabling the air to smoothly flow from the side of the axial end surface 211*a* toward the root side of each blade 212. Thus, the resistance is further decreased between the air and the blade surfaces on the root side of each blade 212, reliably suppressing the stall on the root side of the blades 212.

Further, the curved surface 213 is so formed that the contour 213*a* of the curved surface 213 describes a streamline shape or a wing shape as viewed from the axial direction of the boss 211, enabling the air to flow smoothly from the side of the axial end surface 211*a* toward the root side of each blade 212.

Besides, the curved surface 213 is the one that is curved like a dome contributing to increasing the mechanical strength on the root side of each blade 212.

Figure 4:
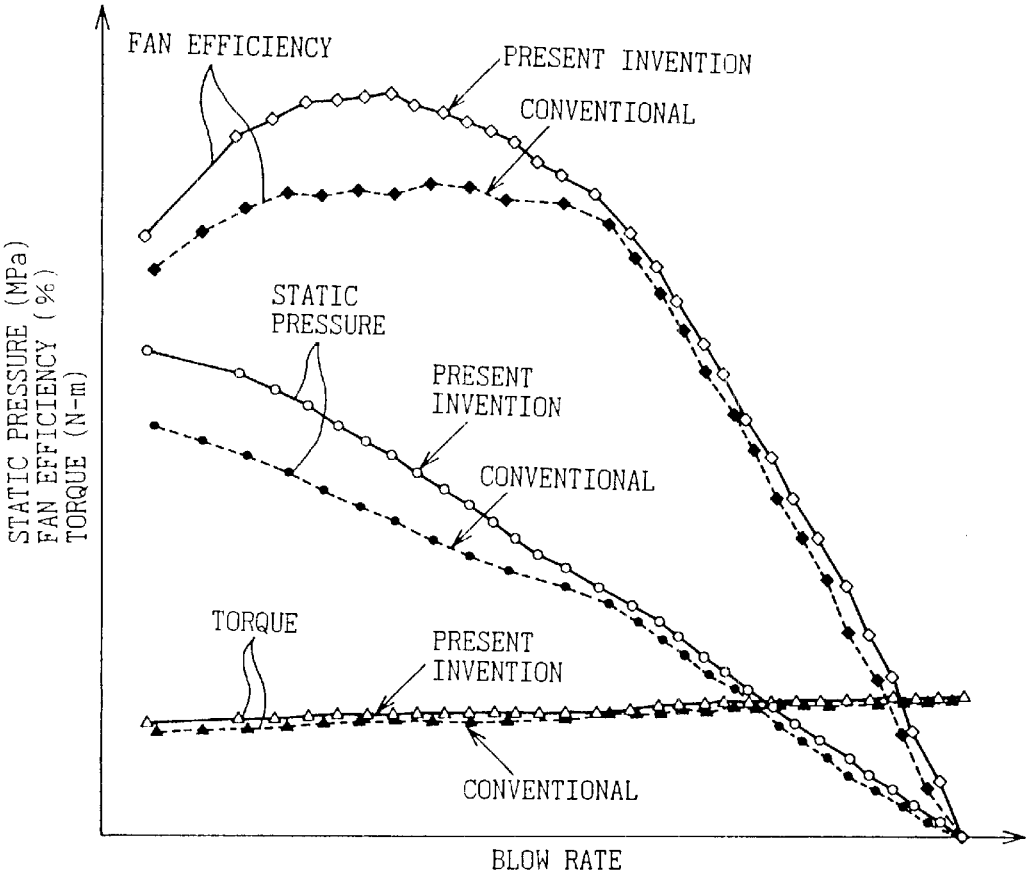
FIG. 4 is a graph illustrating the fan efficiency, static pressure and drive torque of the fan for the flow rate.

FIG. 4 is a graph of test results and illustrates the fan efficiency, static pressure and drive torque of the fan for the blow rate. As will be obvious from this graph, the axial fan according to this embodiment exhibits both improved static pressure and improved fan efficiency using the same torque as that of the axial fan of the prior art.

The words "fan efficiency" and "static pressure" have been defined under JIS B 0132, and the testing methods thereof comply with JIS B 8340.

(Second Embodiment)

Figure 5A:
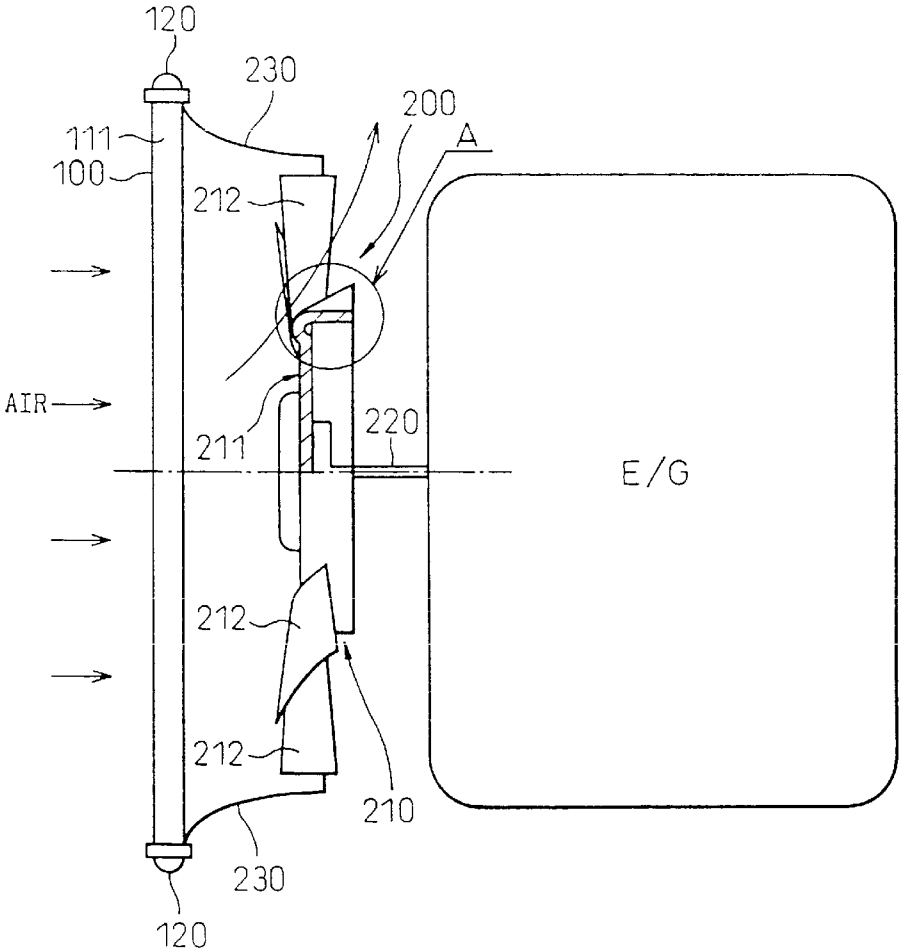
FIG. 5A is a side view of the axial fan according to a second embodiment of the present invention.
Figure 5B:
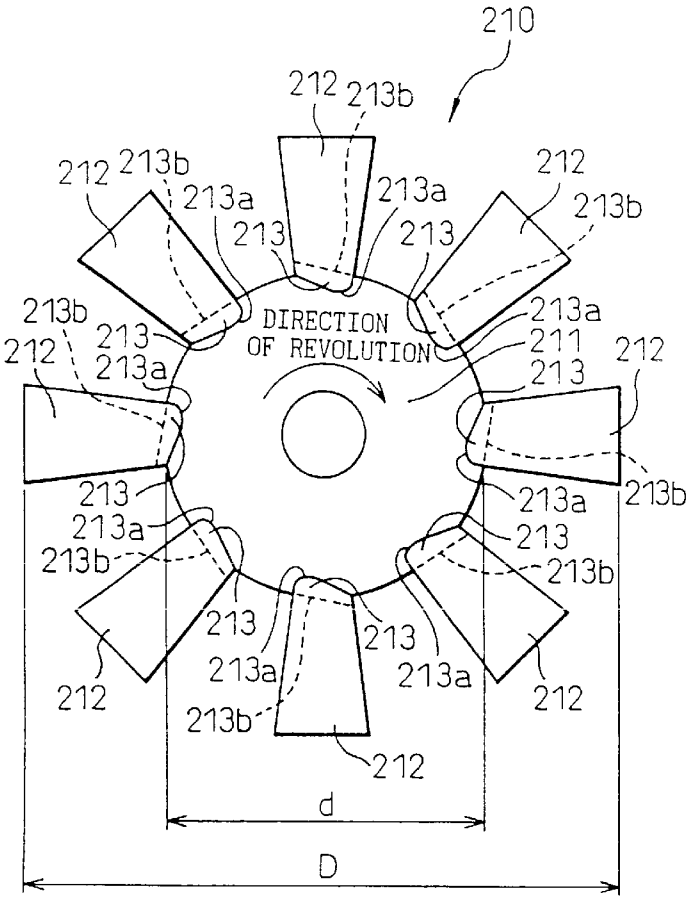
FIG. 5B is a front view of the axial fan according to the second embodiment of the present invention.
Figure 5C:
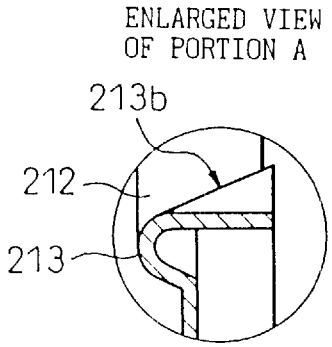
FIG. 5C is a view illustrating a major portion A of FIG. 5A on an enlarged scale.
Figure 6:
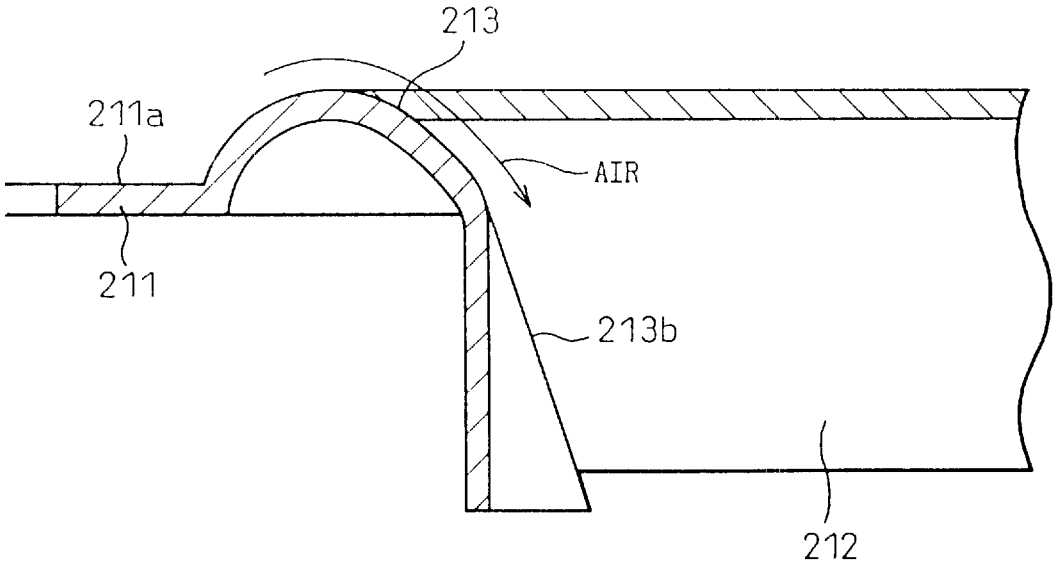
FIG. 6 is a sectional view of the blade and boss of the axial fan according to the second embodiment of the present invention.
Figure 7:
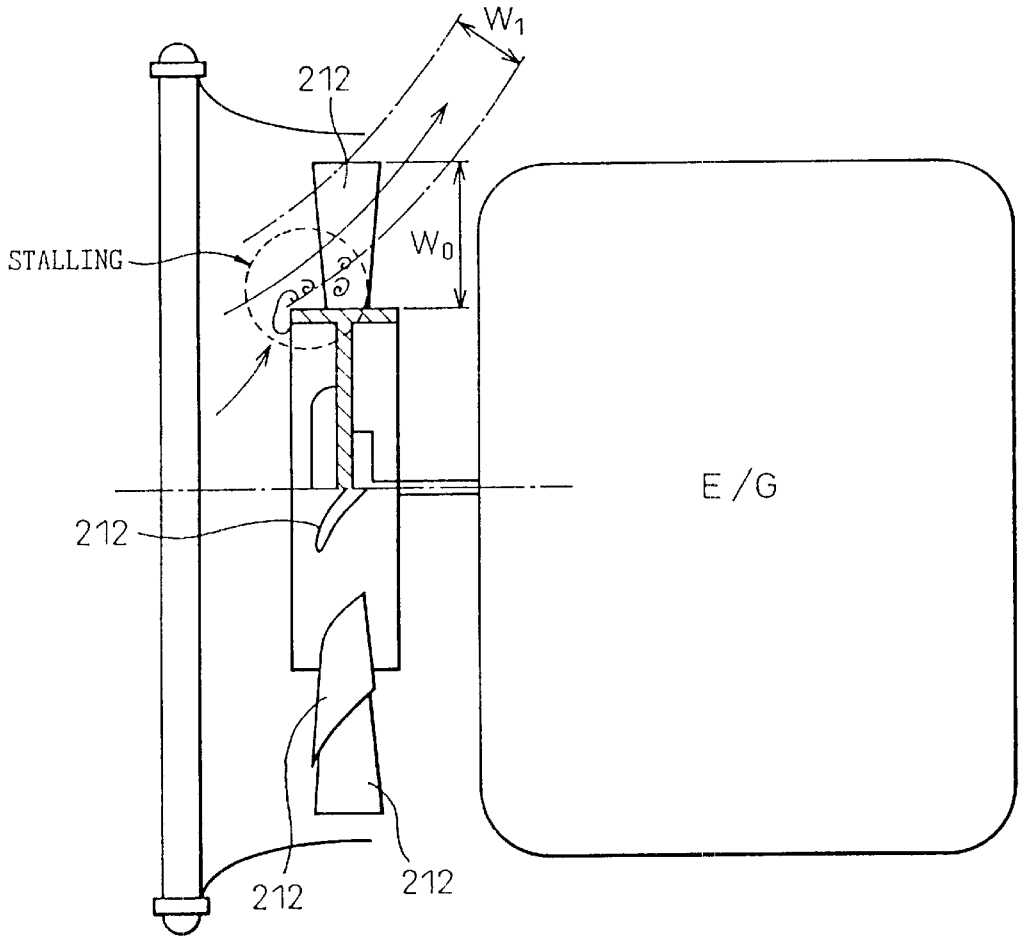
Fig.7 PRIOR ART
FIG. 7 is a side view of an axial fan according to a prior art.

According to this embodiment as shown in FIGS. 5 and 6, a skirt portion 213*b* extends from the curved surface 213 so as to be continuous to the pressure surface side of the blade 212 and expands toward the outer peripheral side, the skirt portion 213*b* being formed from the front edge of the blade 212 toward the rear edge side thereof.

This enables the air to smoothly flow from the upstream side to the downstream side.

(Other Embodiments)

In the above-mentioned embodiments, the axial fan for vehicles of the invention is adapted to cooling the radiator

100. The invention, however, is not limited thereto only but can be adapted to the blowers for the condensers and for other heat exchangers.

According to the invention, as will be obvious from the above-mentioned embodiments, the air is permitted to easily flow from the side of the axial end surface 211*a* toward the root side of each blade 212, suppressing stalling on the root side of the blades 212. Therefore, the effect of the boss 211 (flow rate of the air from the side of the axial end surface 211*a* toward the root side of the blades 212) decreases as the diameter of the boss 211 decreases with respect to the outer diameter D of the axial fan 210.

Accordingly, the invention exhibits its effect more conspicuously for the axial fans having a large ratio (d/D) of the diameter of the boss 211 to the outer diameter D of the axial fan 210. According to a study by the present inventors, it has been confirmed that the invention is particularly effective for axial fans having ratios d/D of not smaller than 0.35.

The invention was described above in detail with reference to particular embodiments. It should, however, be noted that a person skilled in the art would be capable of changing and modifying the invention in a variety of ways without departing from the scope and spirit of the invention.

What is claimed is:

1. An axial fan, for vehicles, having a plurality of blades radially extending from a boss to blow air to a heat exchanger mounted on the vehicle, wherein;

an axial end surface of the boss on the negative pressure side of the blades is so constituted that the air flows toward the root side of each blade from the side of the axial end surface;

the root side of each said blade is continuous to said axial end surface through a smoothly curved surface: and a skirt portion extends from the curved surface so as to be continuous with the pressure surface side of the blade and expands toward the outer peripheral side of the axial fan, the skirt portion being formed from the front edge of the blade toward the rear edge side thereof.

2. An axial fan for vehicles according to claim 1, wherein the curved surface is so formed that the contour line of the curved surface describes a streamline shape as viewed from the axial direction of the boss.

3. An axial fan for vehicles according to claim 1, wherein said boss and said blades are integrally molded together using a resin.

4. An axial fan, for vehicles, having a plurality of blades radially extending from a boss to blow air to a heat exchanger mounted on a vehicle, wherein;

the front edges of the blades are deviated toward the upstream side of the air stream beyond the axial end surface at the axial end of the boss, as viewed from a direction at right angles to the axial direction of the boss; and an axial end surface of the boss connects to part of a root of at least one blade radially inward from an outer peripheral surface of the boss, and a leading portion of the at least one blade in a rotational direction of the at least one blade between the root and a tip thereof protrudes toward the upstream side of the air stream beyond the axial end surface of the boss.

5. An axial fan for vehicles according to claim 4, wherein the root side of each of said blades is continuous with said axial end surface through a smoothly curved surface.

6. An axial fan for vehicles according to claim 5, wherein the curved surface is so formed that the contour line of the curved surface describes a streamline shape, as viewed from the axial direction of said boss.

7. An axial fan for vehicles according to claim 5, wherein a skirt portion extends from the curved surface so as to be continuous to the pressure surface side of the blade and expands toward the outer peripheral side of the axial fan, said skirt portion being formed from the front edge of said blade toward the rear edge side thereof.

8. An axial fan for vehicles according to claim 4, wherein said boss and said blades are integrally molded together using a resin.

* * * * *